US011662086B2

(12) United States Patent
Kansal et al.

(10) Patent No.: US 11,662,086 B2
(45) Date of Patent: May 30, 2023

(54) KNOCKOUT MOUNTABLE LIGHT FIXTURE CONTROLLER ASSEMBLY

(71) Applicant: ABL IP Holding LLC, Atlanta, GA (US)

(72) Inventors: Prashank Kansal, Norcross, GA (US); Ryan D. Meldahl, Newark, OH (US)

(73) Assignee: ABL IP Holding LLC, Atlanta, GA (US)

( * ) Notice: Subject to any disclaimer, the term of this patent is extended or adjusted under 35 U.S.C. 154(b) by 0 days.

(21) Appl. No.: 17/389,960

(22) Filed: Jul. 30, 2021

(65) Prior Publication Data

US 2023/0037127 A1 Feb. 2, 2023

(51) Int. Cl.

| | |
|---|---|
| ***F21V 23/00*** | (2015.01) |
| ***F21V 23/04*** | (2006.01) |
| ***F21V 15/015*** | (2006.01) |
| ***F21S 8/04*** | (2006.01) |

(52) U.S. Cl.

CPC ..... *F21V 23/007* (2013.01); *F21S 8/04* (2013.01); *F21V 15/015* (2013.01); *F21V 23/04* (2013.01)

(58) Field of Classification Search

CPC ..... F21V 23/04; F21V 23/007; F21L 4/005; F21S 8/04

See application file for complete search history.

(56) References Cited

U.S. PATENT DOCUMENTS

| | | | | |
|---|---|---|---|---|
| 2,544,781 | A | 3/1951 | Doane | |
| 2,559,639 | A | 7/1951 | Kruger | |
| 2,924,702 | A | 2/1960 | Block | |
| 3,038,062 | A | 6/1962 | Liberman | |
| 3,652,963 | A | 3/1972 | Fox | |
| 5,223,780 | A | 6/1993 | Hu | |
| 5,384,442 | A | 1/1995 | Danner | |
| 5,702,176 | A | 12/1997 | Engle | |
| 6,050,708 | A | 4/2000 | Roorda | |
| 6,091,200 | A * | 7/2000 | Lenz | H05B 47/11 315/159 |
| 6,555,775 | B1 | 4/2003 | Van Bokhoven et al. | |
| 7,534,975 | B1 * | 5/2009 | Sharrah | F21L 4/027 200/600 |
| 7,596,998 | B2 | 10/2009 | Zimmermann et al. | |
| 7,652,216 | B2 | 1/2010 | Sharrah et al. | |

(Continued)

FOREIGN PATENT DOCUMENTS

| | | |
|---|---|---|
| FR | 2275728 | 1/1976 |

*Primary Examiner* — William N Harris

(74) *Attorney, Agent, or Firm* — Kilpatrick Townsend & Stockton LLP

(57) ABSTRACT

A controller assembly for a light fixture may include a controller housing to be received within a knockout opening of a light fixture housing from which light is emitted, and a user input assembly positioned within the controller housing. The user input assembly may include a mechanical actuator accessible through a controller opening in the controller housing, and a connector interface to be electrically connected by wiring to a driver of the light fixture, and circuitry electrically coupled to the mechanical actuator and the connector interface. The circuitry may be used to detect actuation of the mechanical actuator by a user and, in response, change a control signal from the connector interface to the driver from a first control signal to a second control signal in order change a property of the emitted light.

23 Claims, 13 Drawing Sheets

(56) References Cited

U.S. PATENT DOCUMENTS

| | | | | |
|---|---|---|---|---|
| 7,874,717 | B1 * | 1/2011 | Shaefer | F21S 8/035 362/641 |
| 7,880,100 | B2 | 2/2011 | Sharrah et al. | |
| 7,945,995 | B1 | 5/2011 | Gates | |
| 8,201,965 | B2 | 6/2012 | Yamada et al. | |
| 8,203,090 | B2 | 6/2012 | King | |
| 8,662,695 | B2 | 3/2014 | Wilson | |
| 9,163,814 | B2 | 10/2015 | Plunk et al. | |
| 9,512,969 | B1 * | 12/2016 | Watson | F21V 31/00 |
| 9,541,263 | B2 | 1/2017 | Beausoleil | |
| 9,595,402 | B2 | 3/2017 | Vansickle et al. | |
| 9,761,385 | B2 | 9/2017 | Balgheim et al. | |
| 2008/0253114 | A1 * | 10/2008 | Wen | F21V 17/12 362/205 |
| 2010/0280677 | A1 | 11/2010 | Budike, Jr. | |
| 2014/0240969 | A1 * | 8/2014 | Chen | F21V 14/065 362/187 |
| 2015/0330618 | A1 * | 11/2015 | McDermott | F21V 23/0414 362/208 |
| 2016/0079015 | A1 | 3/2016 | Bauer et al. | |
| 2017/0171932 | A1 * | 6/2017 | Puvanakijjakorn | F21V 23/007 |
| 2020/0063951 | A1 * | 2/2020 | Yu | F21V 19/0015 |
| 2020/0251293 | A1 * | 8/2020 | Voelker | H01H 19/50 |
| 2021/0054990 | A1 * | 2/2021 | Calaceto | F21V 23/007 |

* cited by examiner

105

KNOCKOUT MOUNTABLE LIGHT FIXTURE CONTROLLER ASSEMBLY

BACKGROUND OF THE INVENTION

Light fixtures are available in a wide variety of types, sizes, and lighting property configurations. A common aspect of lighting design involves selecting light fixtures having lighting properties for lighting a space with the desired illumination. Existing light fixtures are manufactured with a single lighting property configuration, and therefore multiple light fixtures of the same type and size may be manufactured with different lighting property configurations, which is disadvantageous from a production and inventory standpoint.

BRIEF SUMMARY OF THE INVENTION

The terms "invention," "the invention," "this invention" and "the present invention" used in this patent are intended to refer broadly to all of the subject matter of this patent and the patent claims below. Statements containing these terms should not be understood to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to the entire specification of this patent, all drawings, and each claim.

In some embodiments, the present technology relates to a controller assembly for a light fixture. The controller assembly may include a controller housing to be received within a knockout opening of a light fixture housing from which light is emitted, and a user input assembly positioned within the controller housing. The user input assembly may include a mechanical actuator accessible through a controller opening in the controller housing, and a connector interface to be electrically connected by wiring to a driver of the light fixture, and circuitry electrically coupled to the mechanical actuator and the connector interface. The circuitry may be used to detect actuation of the mechanical actuator by a user and, in response, change a control signal from the connector interface to the driver from a first control signal to a second control signal in order change a property of the emitted light.

In some embodiment, the controller housing may include a main body portion. The main body portion may define an internal cavity and the user input assembly may be positioned within the internal cavity. The main body portion may define a first end and a second end opposite the first end, and an end cap may be coupled to the first end of the main body portion. The end cap may define the controller opening proximate the first end of the main body portion. In some embodiments, the controller assembly may also include a nut, and the main body portion may defines a sidewall and a flange extending radially from the sidewall. The sidewall may also define threading proximate to the flange, and the nut may be threadedly coupled to the threading. The nut and flange may be used to clamp the light fixture housing around the knockout opening in order to couple the controller housing to the light fixture housing.

In some embodiments, the main body portion may define a top portion and a bottom portion. The top portion and the bottom portion may snap together to define the main body portion. The top and bottom portions each may define a portion of the flange and a portion of the threading. The end cap may rotatably couple to the flange. The flange may define a T-shaped channel, and the end cap may define a tab. The end cap may rotatably couple to the flange by inserting the tab into the T-shaped channel and rotating that end cap relative to the flange. The controller opening in the end cap may be offset radially from an axis of rotation of the end cap. The mechanical actuator may extend through the controller opening during rotational coupling of the end cap to the flange. The controller opening may be arc shaped.

In some embodiments, the mechanical actuator includes a toggle push button. In some embodiments, the mechanical actuator includes a rotatable dial.

In some embodiments, an interior sidewall of the main body portion defines channels, the circuitry comprises a printed circuit board, and the printed circuit board engages the channels and is inserted into the internal cavity by sliding along the channels. The channels may include end stops, and the end stops block the channels proximate the second end of the main body portion so that the printed circuit board is retained within the internal cavity by the end cap and the end stops.

In some embodiments, the main body portion defines a main body opening proximate the second end of the main body portion, and the main body opening provides access to the connector interface in order for the wiring to extend from the connector interface out of the internal cavity and be routed to the driver of the light fixture.

In some embodiments, a light fixture includes the controller assembly as disclosed herein, and a light fixture housing defining a knockout opening. The controller assembly may be positioned within the knockout opening. The light fixture may also include a light source and a driver positioned within the housing and electrically coupled to the controller assembly and the light source. The driver is used to drive the light source. The driver may be configured to receive a control signal from the user input assembly of the controller assembly and, in response to detecting a change from receiving a first control signal to receiving a second control signal, change the drive signal to the light source from a first drive signal corresponding to a first light property setting to a second drive signal corresponding to a second light property setting. The first and second light property settings may include light intensity settings. The first and second light property settings may include color temperature settings.

A light fixture may be assembly by removing a knockout from the light fixture housing in order to define the knockout opening, inserting the controller housing into the knockout opening, and connecting the wiring between the connector interface and the driver. The controller housing may include a main body portion defining a sidewall and a flange extending radially from the sidewall. The sidewall may define threading proximate to the flange. The method of assembly may include threading a nut onto the threading in order to clamp a portion of the light fixture housing around the knockout opening between the nut and the flange. The controller housing may also include an end cap defining the controller opening, and the method of assembly may include coupling the end cap to the main body portion by rotating the end cap relative to the main body portion with a portion of the mechanical actuator extending through the controller opening.

BRIEF DESCRIPTION OF THE DRAWINGS

The features and components of the following figures are illustrated to emphasize the general principles of the present technology. Corresponding features and components throughout the figures can be designated by matching reference characters for the sake of consistency and clarity.

DETAILED DESCRIPTION OF THE INVENTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described. Directional references such as "up," "down," "top," "left," "right," "front," and "back," among others are intended to refer to the orientation as illustrated and described in the figure (or figures) to which the components and directions are referencing.

Figure 1A:
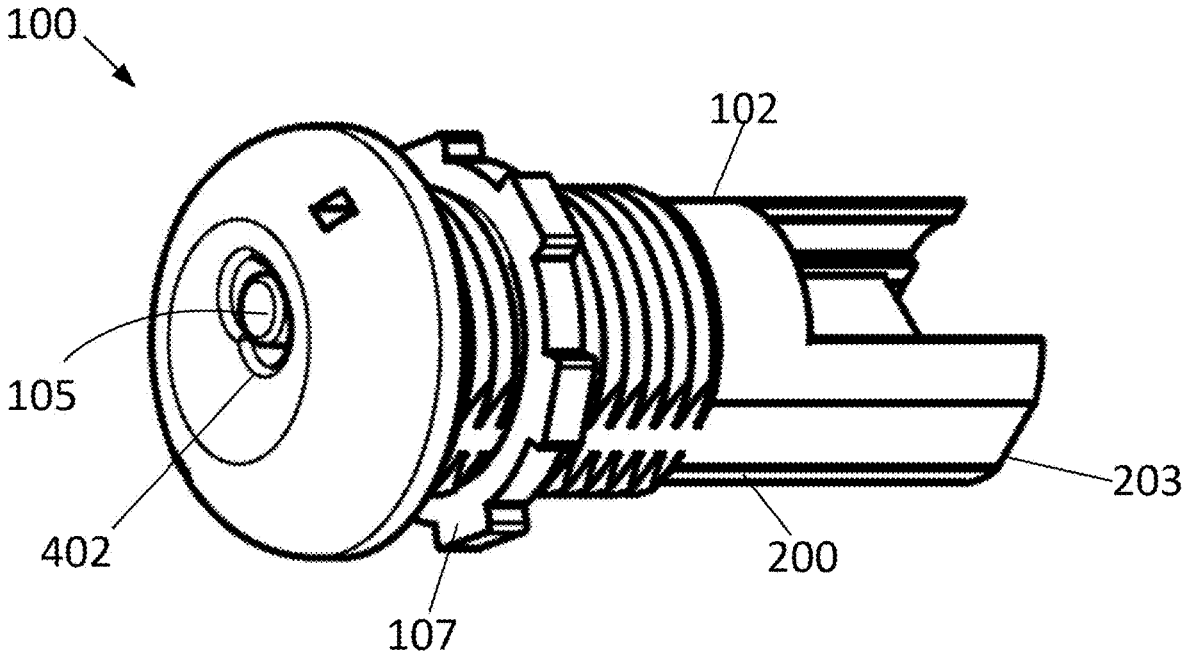
FIGS. 1A-1F show views of a knockout mountable light fixture controller assembly according to embodiments of the present technology.
Figure 1B:
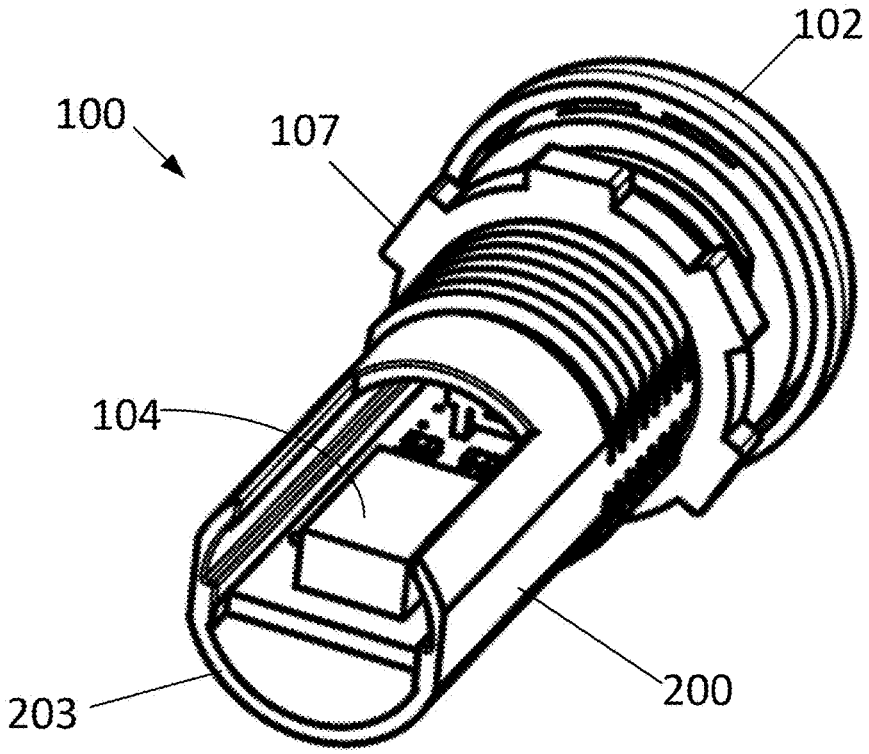

FIGS. 1A-1F show views of a knockout mountable light fixture controller assembly 100, hereinafter referred to as a controller assembly 100. As will be discussed in greater detail below, the controller assembly 100 may be mounted within a knockout opening of a light fixture housing and electrically connected to drivers or controllers within the light fixture in order to allow a user to change properties of light output by the light fixture. As shown in FIG. 1A, the controller assembly 100 may include a housing 102 in which a user input assembly 104 is positioned. In some embodiments, for example as shown in the front side perspective view of FIG. 1A, the user input assembly 104 includes a mechanical actuator 105 accessible to a user through an opening in a portion of the housing 102. As shown in the rear perspective view of FIG. 1B, in some embodiments, the housing 102 may provide access to the user input assembly 104, for example to allow access for control cabling to connect between the user input assembly 104 and a driver of a light fixture.

Figure 1C:
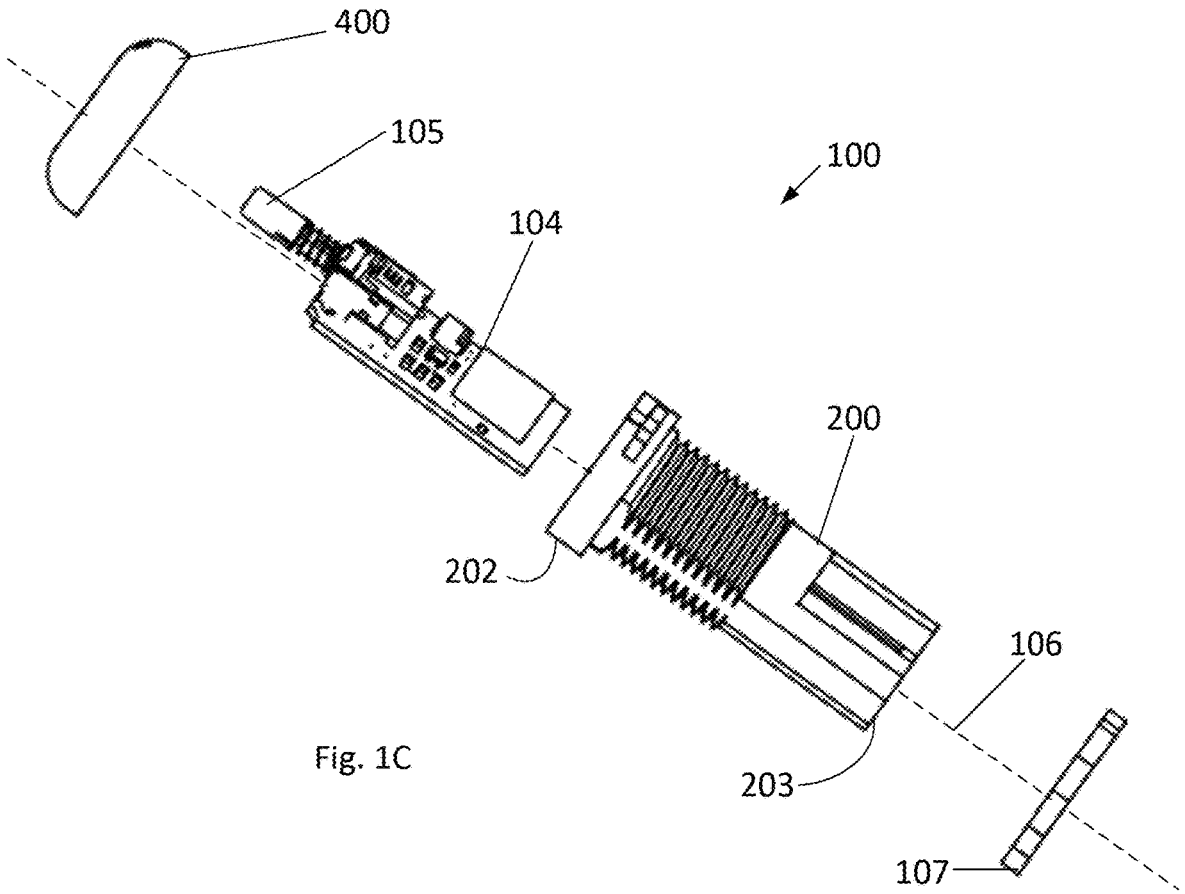
Figure 1D:
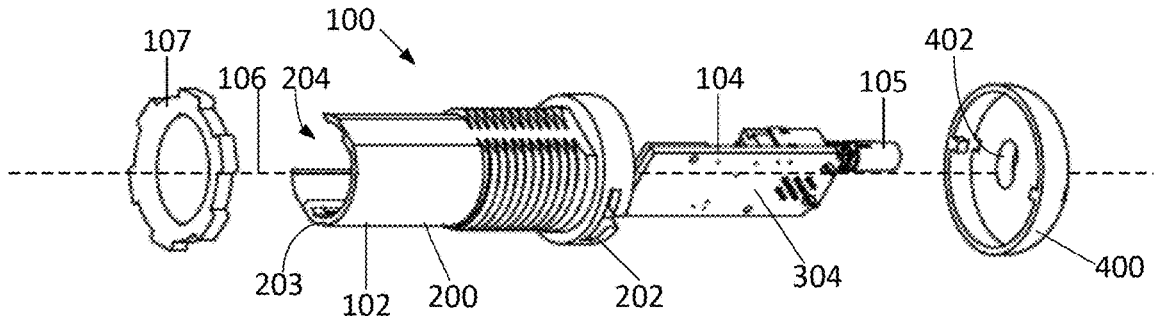
Figure 2A:
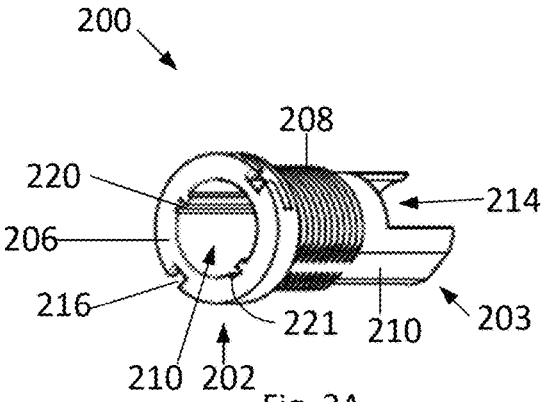
FIGS. 2A-2H show views of a main body portion of a housing of a knockout mountable light fixture controller assembly according to embodiments of the present technology.

FIGS. 1C and 1D show exploded views of a controller assembly 100, exploded along a longitudinal axis 106. In some embodiments, for example as shown, the housing 102 includes a main body portion 200 and an end cap 400. The end cap 400 may be coupled to the main body portion 200 at a first end 202 of the main body portion 200 in order to retain the user input assembly 104 within an internal cavity 204 defined by the main body portion 200. In some embodiments, the housing 102 may also include a knockout coupling mechanism in order to couple the controller assembly 100 to a light fixture housing when the controller assembly 100 is within a knockout opening of a light fixture housing. For example as shown in FIG. 2A, the knockout coupling mechanism may include a flange 206 defined at the first end 202 of the main body portion 200 and a coupling nut 107 threadedly coupled to the threading 208 defined on the main body portion 200 adjacent to the flange 206. In some embodiments, the knockout coupling mechanism may include snap tabs define on the main body portion 200 configured to engage the inner perimeter of a knockout opening in order to snap couple the main body portion 200 into the knockout opening.

Figure 1E:
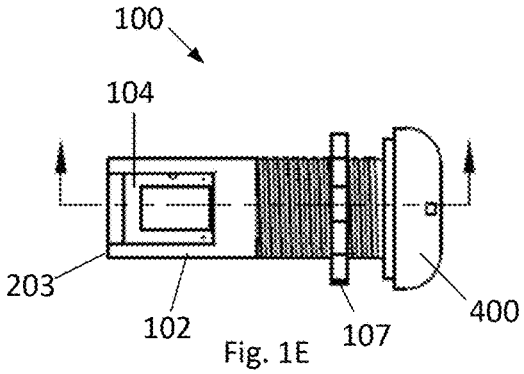
Figure 1F:
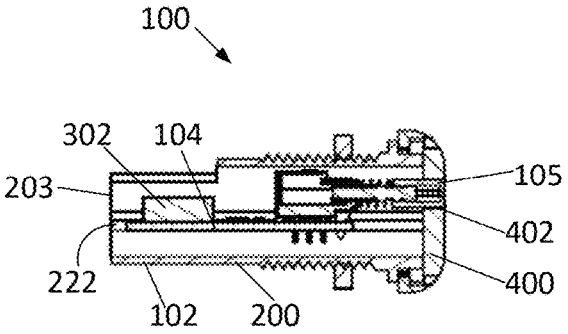

In some embodiments, the user input assembly 104 is positioned entirely within the housing 102, which is beneficial in protecting circuitry of the user input assembly 104 from damage as well as protecting the mechanical actuator 105 from unintentional manipulation. For example, as shown in the cross-sectional view of FIG. 1F, as indicated in FIG. 1E, the user input assembly 104 is positioned within the internal cavity 204 of the main body portion 200 with a portion of the mechanical actuator 105 positioned within an opening 402, also referred to as a controller opening, defined by the end cap 400. Further, as shown in FIG. 1F, a connector interface 302 of circuitry of the user input assembly 104 is positioned proximate to a second end 203 of the main body portion 200, opposite the first end 202.

Figure 2B:
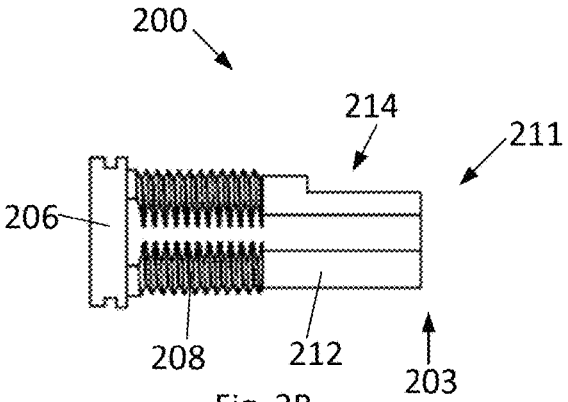
Figure 2C:
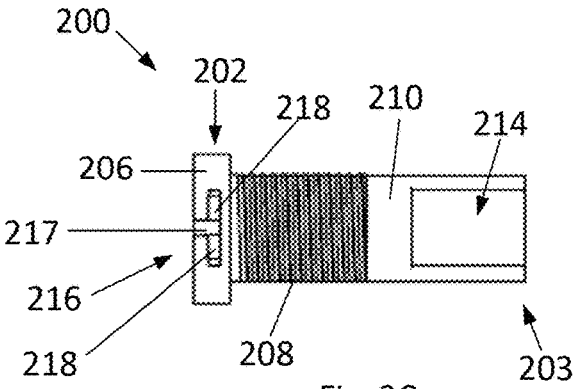
Figure 2D:
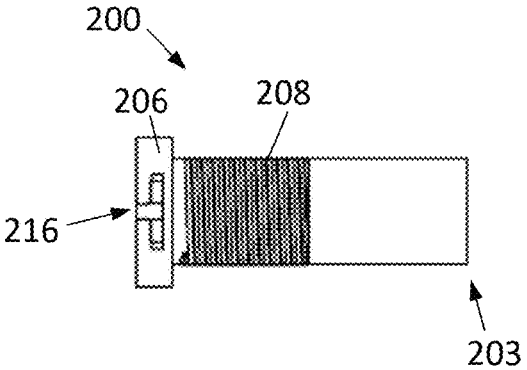
Figure 2E:
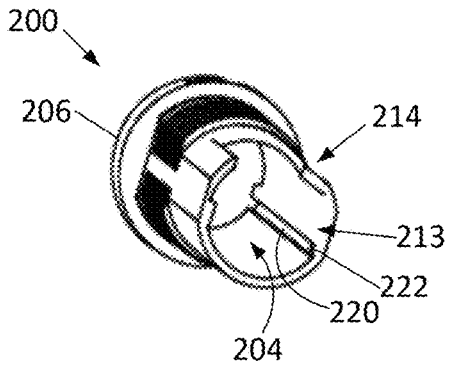

FIGS. 2A-2H show views of an embodiment of a main body portion 200 of a housing 102. In some embodiments, the main body portion 200 may be an elongated cylinder in shape, i.e. tubular. The sidewall of the elongated cylinder may define a cylindrical internal cavity 204, as shown in FIG. 2E. The elongated cylinder may extend along the longitudinal axis 106 between the first end 202 and the second end 203. The first end 202 of the main body portion 200 may define a first opening 210 into the internal cavity 204. The first opening 210 may provide access to the internal cavity 204 in order to position the user input assembly 104 into the internal cavity 204. As shown in FIG. 2A, the first opening 210 at the first end 202 may be circular.

The first end 202 of the main body portion 200 may include a flange 206 at the first end 202. The flange 206 may extend radially away from the longitudinal axis 106 and be larger than the outer sidewall 212 of the main body portion 200. For example as shown in FIGS. 2A and 2B, a flange 206 at the first end 202 may be a circular disk with a larger circular diameter than a circular diameter of the sidewall 212. The flange 206 may be sized and shaped to be larger than the knockout opening of the light fixture housing so that the flange 206 abuts an outer surface of the light fixture housing around the knockout opening.

As noted above, the coupling mechanism for coupling the controller assembly 100 to the housing of a light fixture may include threading 208 and a nut 107. The main body portion 200 may define the threading 208 on the outer surface of the sidewall 212 proximate to the flange 206 to engage the nut 107 to clamp to the light fixture housing around the knockout opening between the flange 206 and the nut 107, as shown in FIG. 8C discussed below.

Figure 2F:
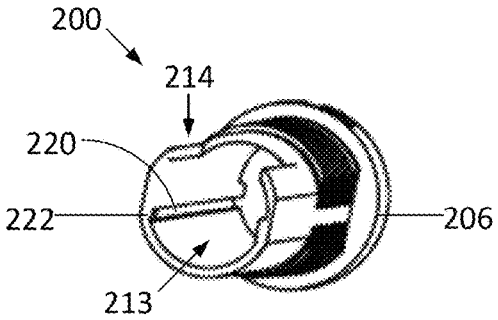

The second end 203 of the main body portion 200 may define a second opening 211 into the internal cavity 204 of the main body portion 200. The second opening 211 may provide access to the connector interface 302 of the user input assembly 104 in order to electrically couple the user input assembly 104 to a driver or controller of a light fixture. The second opening 211 may include a circular opening portion 213. The second opening 211 may include a sidewall opening portion 214 defined as an opening in the sidewall 212 of the main body portion 200. For example as shown in FIG. 2C, the second opening 211 may include a rectangular sidewall opening portion 214 extending in the longitudinal direction. As shown in FIGS. 2E and 2F the second opening 211 may include both the circular opening portion 213 and the sidewall opening portion 214.

The flange 206 may include features for coupling the end cap 400 to the main body portion 200. In some embodiments, the features may include one or more T-shaped channels 216 defined in the radial sidewall of the flange 206. For example as shown in FIGS. 2C and 2D, the flange 206 may define two t-shaped channels 216 radially opposed to each other. Each T-shaped channel 216 may include an entry channel portion 217 extending in the longitudinal direction, and two locking radial portions 218 extending in opposite direction radially around the flange 206. As will be discussed in greater detail below, a tab 404 of the end cap 400 may be inserted into the entry channel portion 217 until the tab 404 reaches an end of the entry channel portion 217, and the end cap 400 may then be rotated in either direction so that the tab 404 is retained in one of the two locking radial portions 218. The locking radial portions 218 may include detents for preventing reverse rotation, and therefore uncoupling of the end cap 400 from the flange 206. In some embodiments, the features may include threading for threadedly coupling the end cap 400 to the flange 206, or may include a lip for snap-fitting the end cap 400 to the flange 206.

Figure 2G:
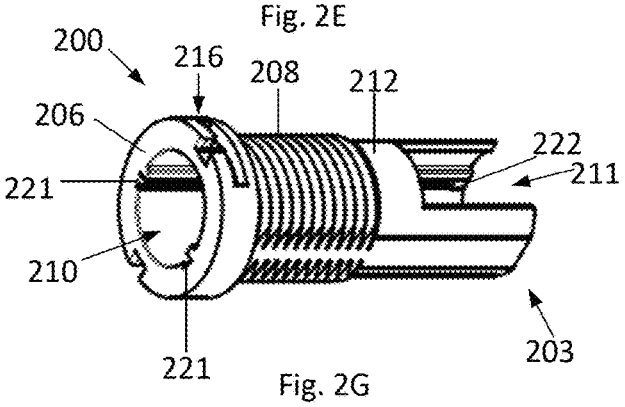
Figure 2H:
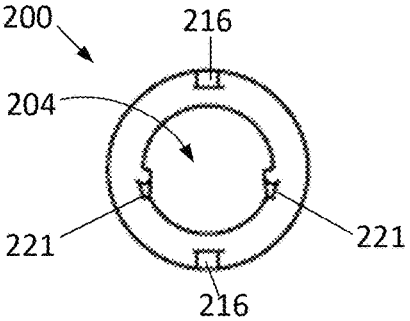
Figure 3A:
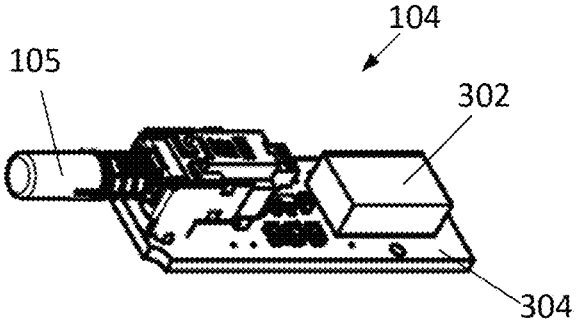
FIGS. 3A-3D show views of a user input assembly of a knockout mountable light fixture controller assembly according to embodiments of the present technology.
Figure 3B:
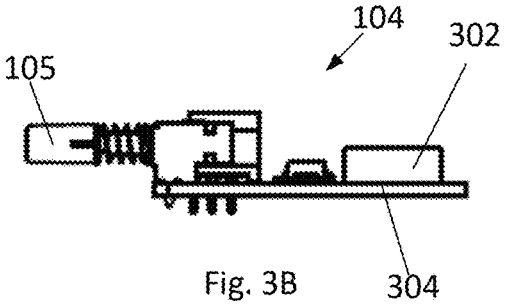
Figure 3C:
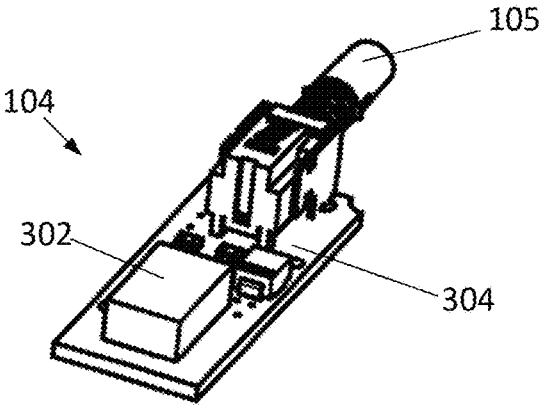
Figure 3D:
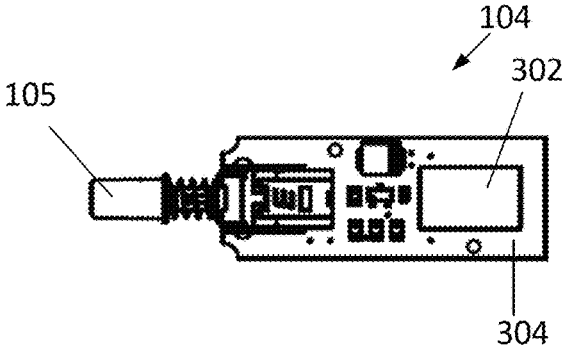

The internal cavity 204 may define channels 220 for receiving the user input assembly 104. For example as shown in FIGS. 2E-2H, the internal surfaces of the sidewalls 212 of the cylindrical internal cavity 204 may define channels 220 extending parallel to the longitudinal axis 106. The channels 220 may be rectangular channels for receiving edges of a circuit board 304 of the user input assembly 104. The channels 220 may extend in the longitudinal direction of the main body portion 200 from the first end 202 toward the second end 203. The channels 220 may each define an open end 221 at the first end as shown in FIGS. 2G and 2H to allow the user input assembly 104 to be inserted into the first opening 210 and engage and slide along the channels 220. The channels 220 may define an end stop 222 proximate to the second end 203 in order to prevent the user input assembly 104 from translating out of the internal cavity 204 from the second end 203 when the user input assembly 104 is slid into place. The length of the channel 220 between the first end 202 and the end stop 222 may correspond to the length of the user input assembly 104.

In some embodiments, the user input assembly 104 includes circuitry connected to the mechanical actuator 105. The circuitry may be included in a printed circuit board 304. The mechanical actuator 105 may be mechanically and electrically coupled to the circuitry, for example the circuit board 304. Actuation of the mechanical actuator 105 may cause the circuitry to output a control signal receivable by a driver, or controller, of a light fixture, as will be discussed in greater detail below.

FIGS. 3A-3D show views of an embodiment of a user input assembly 104. As noted above, a user input assembly 104 may include circuitry, for example a circuit board 304, a mechanical actuator 105, and a connector interface 302. The connector interface 302 may include, but is not limited to, a terminal block, a header, or pads to solder wires. The user input assembly 104 may be generally rectangular and may be sized and shaped to be retained within the internal cavity 204 of the main body portion 200, as shown in FIG. 1F.

The circuit board 304 may be populated with circuitry components, including resistors, capacitors, transistors, and integrated circuit chips (for example programmable logic chips). The circuitry components may translate inputs from the mechanical actuator 105 into electrical control signals to wires connected to the connector interface 302. The control signals may correspond to different light property configurations of the light fixture. The light property configurations may include, but are not limited to, intensity/brightness, color temperature, and color. In some embodiments, the user input assembly 104 may include a plurality of mechanical actuators 105 coupled to the circuitry, for example the circuit board 304. Each mechanical actuator 105 may correspond to control of a different property of light emitted from the light fixture, and/or control a different portion of the light fixture.

In some embodiments, the mechanical actuator 105 may be a toggle push button, a switch, a slider, and/or a dial. For example, as shown in FIGS. 3A-3D, the mechanical actuator 105 may be a toggle push button. The circuitry of the circuit board 304 may be configured so that actuation of the toggle push button changes a control signal from a first control signal to a second control signal. The different control signals may include, but are not limited to, different resistances, different voltages, different currents, and different modulating signals (e.g. different frequencies, amplitudes and/or patterns thereof).

In some embodiments, actuating the mechanical actuator 105, for example pressing the button once, may cause the control signal to toggle from a first control signal to a second control signal, corresponding to different driver settings for outputting different light properties. For example, each press of the button may cause a change between a first control signal corresponding to a first setting (e.g. 14K lumens), and a second control signal corresponding to a second setting (e.g. 20K lumens). In some embodiments, each press of the button may cause the output control signal to cycle through a series of three or more different control signals. For example, with the circuitry outputting a first control signal, a press of the button may cause a change to outputting a second control signal. With the circuitry outputting the second control signal, a press of the button may result in a change to outputting a third control signal. With the circuitry outputting the third control signal a press of the button may result in a change to outputting back to the first control signal to complete the series. The series of different control signals may include any number of control signals, for example 5 different signals corresponding to 5 different levels of brightness.

In some embodiments, the mechanical actuator 105 is a dial, rotatable around an axis. Rotation may be detected by the circuitry and cause the circuitry to change the control signal in order for the light properties of the light fixture to be changed. In some embodiments, the dial includes predetermined discrete radial positions, e.g. click positions, each corresponding to a discrete control signal corresponding to a discrete light fixture setting. In some embodiments, rotation of the dial corresponds to a continuous change of a control signal corresponding to continuous change of light fixture settings. For example, rotating the dial may correspond to a continuous change of color around the spectrum from red to violet, including all hues in between.

Figure 4A:
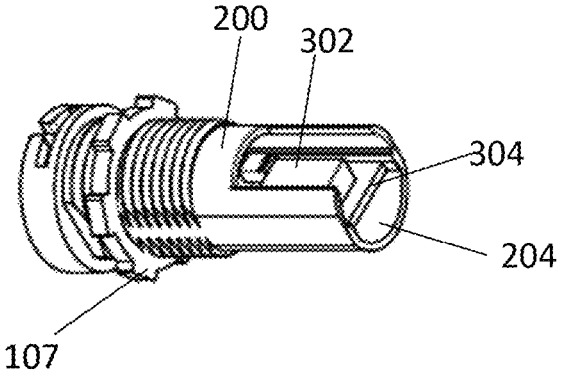
FIGS. 4A-4D show views of a sub-assembly of a main body portion and a user input assembly of a knockout mountable light fixture controller assembly according to embodiments of the present technology.
Figure 4B:
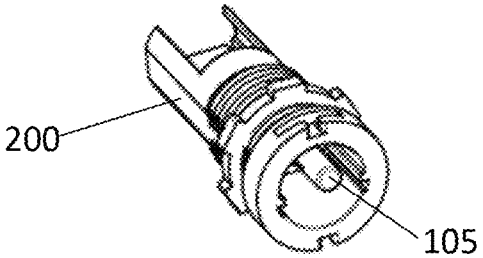
Figure 4C:
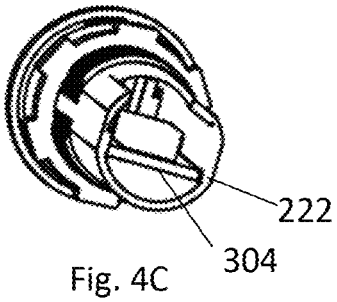
Figure 4D:
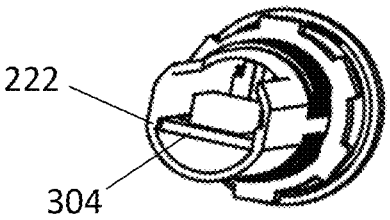
Figure 9A:
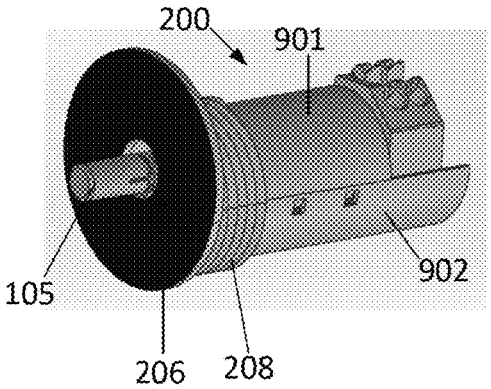
FIGS. 9A-9D show views of a knockout mountable light fixture controller assembly according to embodiments of the present technology.
Figure 9B:
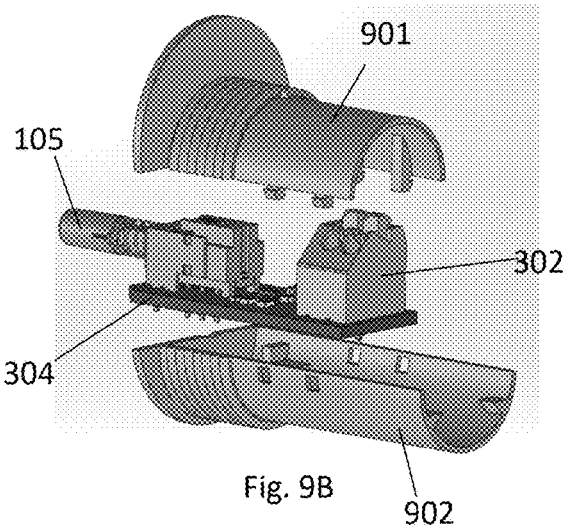
Figure 9C:
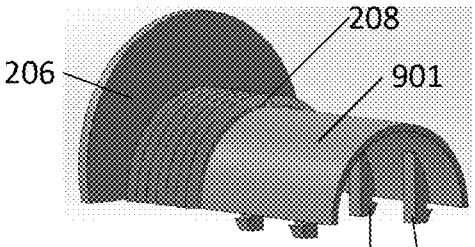
Figure 9D:
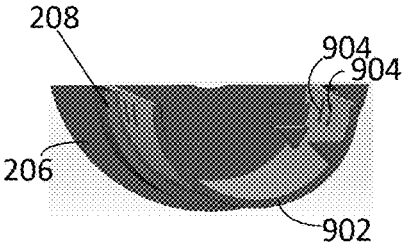

FIGS. 4A-4B show a sub-assembly of the main body portion 200 of the housing 102 and the user input assembly 104. As shown, the user input assembly 104 is positioned within the internal cavity 204 of the main body portion 200. As noted above, in some embodiments, the user input assembly 104 may be slid into the internal cavity 204 from the first opening 210, with sides of the circuit board 304 engaging the channels 220. In some embodiments, the user input assembly 104 may be slid into the internal cavity 204 from the second opening 211. In some embodiments, for example as shown in FIGS. 9A-9D, the main body portion 200 may be formed of multiple components, which snap together, and the user input assembly 104 may be assembled between the multiple components. For example, as shown the main body portion 200 may include a top portion 901, FIG. 9C, and a bottom portion 902, FIG. 9D. The top portion 901 includes tabs 903 which snap into notches 904 defined by the bottom portion 902. As shown in FIG. 9A, the top portion 901 and the bottom portion 902 may together define the flange 206 and threads 208 as discussed above.

The user input assembly 104 may be positioned within the main body portion 200 of the housing so the connector interface 302 is positioned proximate to the second opening 211, as shown in FIG. 4A, in order to be accessible for connecting cables connected to the driver of the light fixture. The mechanical actuator 105 may be positioned proximate to the first opening 210 as shown in FIG. 4B.

Figure 5A:
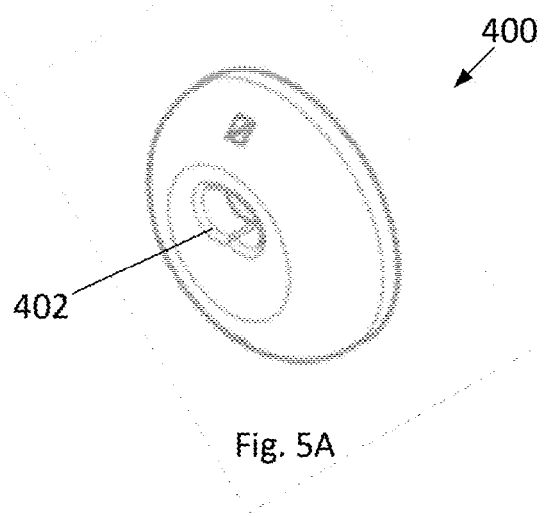
FIGS. 5A-5D show views of an end cap of a housing of a knockout mountable light fixture controller assembly according to embodiments of the present technology.
Figure 5B:
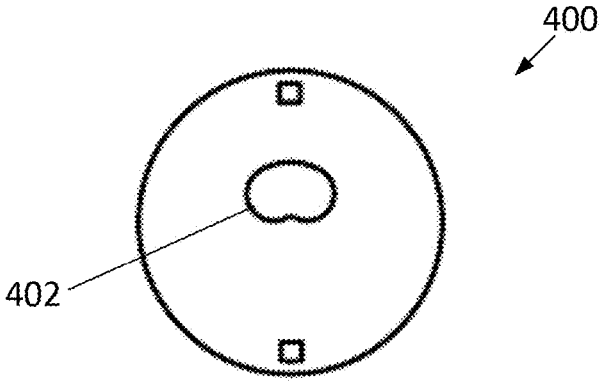
Figure 5C:
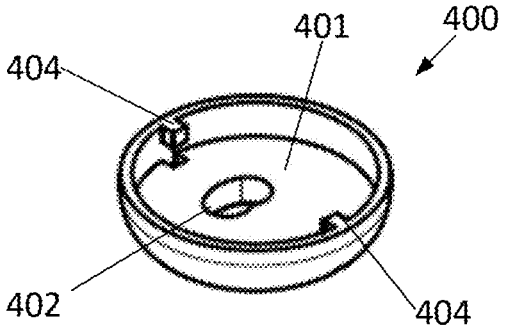
Figure 5D:
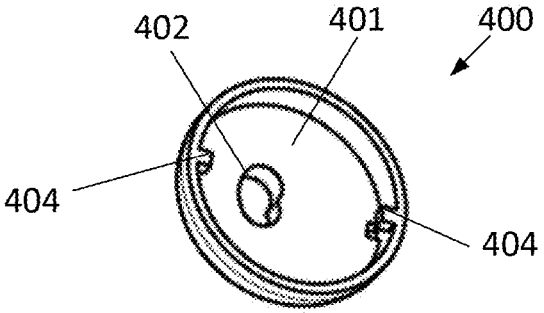

FIGS. 5A-5D show an embodiment of an end cap 400. As noted above, in some embodiments, the end cap 400 is removably coupled to the main body portion 200 of the housing 102. The end cap 400 may substantially cover the first opening 210 at the first end 202 of the main body portion 200. In some embodiments, for example as shown in FIGS. 5C and 5D, the end cap 400 is disk shaped, and includes a recess 401. The recess 401 may be shaped and sized to fit around the flange 206. In some embodiments, the end cap 400 includes tabs 404 within the recess 401 to be received within a T-shaped channel 216 of the flange 206. The end cap 400 may define an opening 402 for the mechanical actuator 105. In some embodiments, the mechanical actuator 105 may extend through and out of the opening 402. In some embodiments, the mechanical actuator 105 may extend into and reside in the opening 402. In some embodiments, the opening 402 may provide access for a user to access the mechanical actuator 105 within the internal cavity 204 of the main body portion 200. In some embodiments, the opening 402 may be centered on the longitudinal axis 106 of the main body, or may be radially offset from the longitudinal axis 106.

Figure 6A:
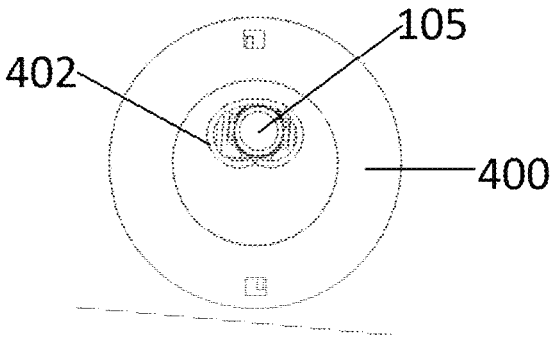
FIGS. 6A-6C show views of rotation of an end cap of a housing of a knockout mountable light fixture controller assembly according to embodiments of the present technology.
Figure 6B:
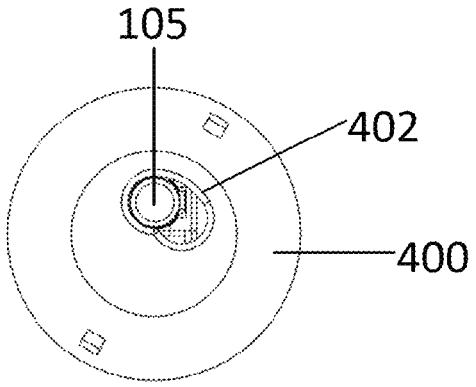
Figure 6C:
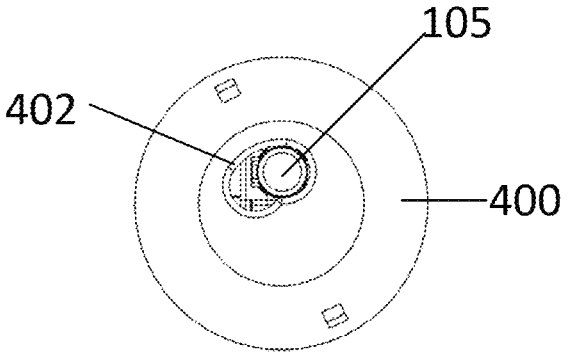

In some embodiments, the opening 402 may be shaped, sized, and positioned so that the end cap 400 may rotate around the longitudinal axis 106 while the mechanical actuator 105 is positioned within the opening 402, for example when coupling the end cap 400 to the flange 206. For example, the opening 402 may be arced with a bean shape as shown in FIG. 5B. In some embodiments, the opening 402 is shaped to allow for rotation of the end cap 400 with a mechanical actuator 105 offset from the longitudinal axis 106. For example, to couple the end cap 400 as shown in FIG. 5A to a flange 206, the tabs 404 of the end cap 400 may be positioned within the T-shaped channels 216, and the end cap 400 may be translated over the flange 206 so that the flange 206 is within the recess 401. In this position, the mechanical actuator 105 may be positioned in a central portion of an arced opening 402, as shown in FIG. 6A. The end cap 400 may then be rotated clockwise, FIG. 6B, or counter-clockwise, FIG. 6C, in order to couple the end cap 400 to the flange 206. The arced opening 402 allows for the rotational motion of the end cap 400 with the radially offset mechanical actuator 105. In some embodiments, for example as shown in FIGS. 6A-6C, the coupling of the end cap 400 may be accomplished with less than 20 degrees of relative rotation of the end cap 400 and main body portion 200 which is beneficial in maintaining a small opening 402 thus protecting the contents of the housing 102.

The controller assembly 100 may be coupled to a housing of a light fixture so that the end cap 400 is positioned outside of the housing of the light fixture and the circuitry of the user input assembly 104 is positioned inside of the housing of the light fixture, with the mechanical actuator 105 accessible from outside of the housing of the light fixture so that a configuration of the light properties of the light output by the light fixture may be changed via the mechanical actuator 105 without opening the housing of the light fixture. FIGS. 7A-7D show steps of coupling a controller assembly 100 to a housing 700 of a light fixture.

Figure 7A:
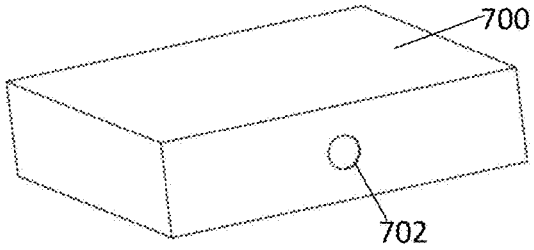
FIGS. 7A-7D shows views of a light fixture housing coupled to a knockout mountable light fixture controller assembly according to embodiments of the present technology.
Figure 7B:
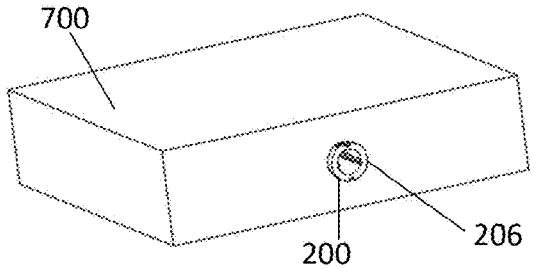

As shown in FIG. 7A, a first step may include removing knockout from the housing 700 of light fixture. The knockout may be a partially stamped portion of the housing removable to define a knockout opening 702 of a predetermined size, for example 0.875". As shown in FIG. 7B, with the knockout opening 702, defined the main body portion 200 of the housing, may be placed in the knockout opening 702 and clamped to housing with the flange 206 remaining outside of the housing 700. For example, as discussed above, the flange 206 may be sized and shaped to be larger than the knockout opening 702 of the light fixture housing 700 so that the flange 206 abuts an outer surface of the light fixture housing 700 around the knockout opening 702, and then a nut 107 may be threaded on the threads 208 proximate to the first end 202, after the main body portion 200 is inserted into the knockout opening 702. In some embodiments, the main body portion 200 may include spring tabs sized for a press-fit within the knockout opening 702.

Figure 7C:
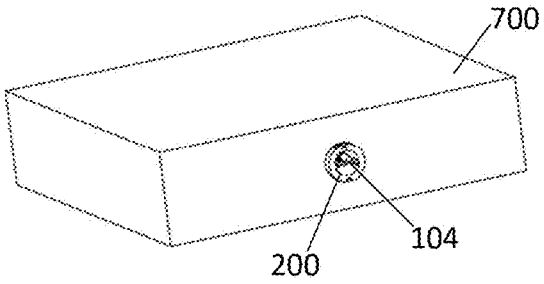

As shown in FIG. 7C, with the main body portion 200 positioned within the knockout opening 702, the user input assembly 104 may be inserted in the internal cavity 204 of the main body portion 200. In some embodiments, the user input assembly 104 may be positioned within the main body portion 200 prior to inserting the main body portion 200 into the knockout opening 702.

In some embodiments, wiring connected between the connector interface 302 and a driver of the light fixture may be pulled through the main body portion 200 from the second opening 211 and through the first opening 210 prior to inserting the user input assembly 104 into the internal cavity 204 of the main body portion 200. In some embodiments, the user input assembly 104 may be inserted into the main body portion 200 prior to connecting the wires to the connector interface 302.

Figure 7D:
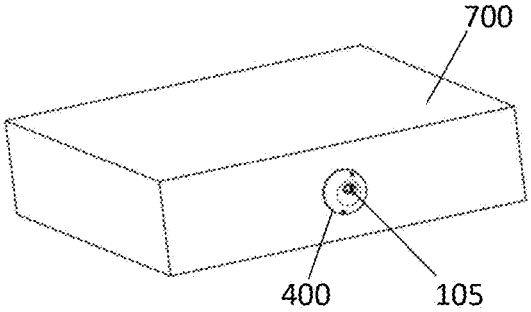

As shown in FIG. 7D, with the user input assembly 104 placed within the main body portion 200 the end cap 400 may be coupled to the main body portion 200, as shown in FIG. 7D, in order to retain the user input assembly 104 within the internal cavity 204. For example, the user input assembly 104 may be positioned within the channels 220 and prevented from translation, e.g. sliding along the channels 220, in the longitudinal direction by the stop end stop 222 and the end cap 400. In some embodiments, for example as shown in FIG. 7D, the end cap 400 is coupled to the main body portion 200 with the mechanical actuator 105 accessible through the opening 402.

Figure 8A:
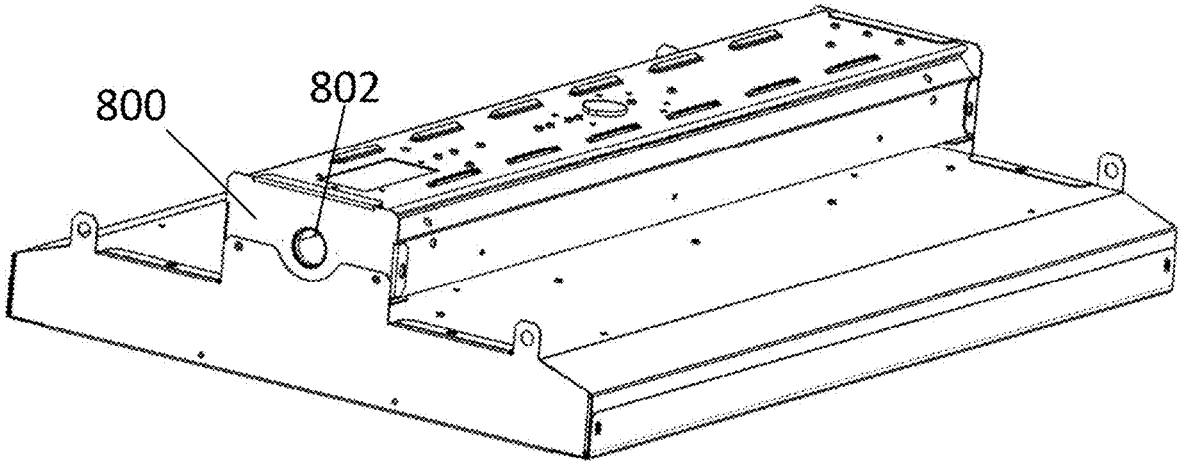
FIGS. 8A-8C shows views of a light fixture housing coupled to a knockout mountable light fixture controller assembly according to embodiments of the present technology.
Figure 8B:
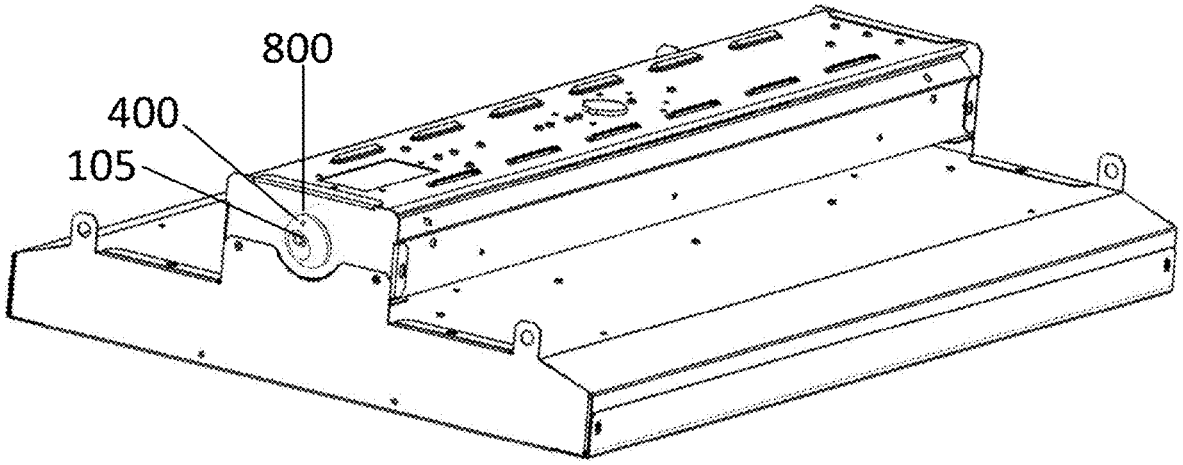
Figure 8C:
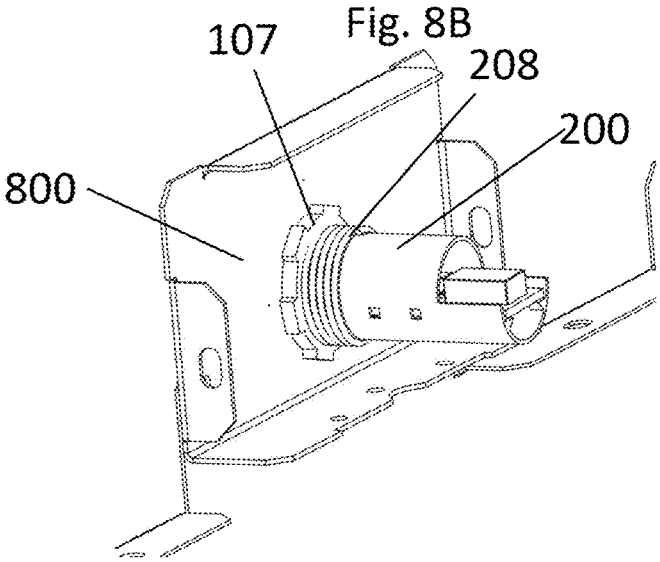

FIGS. 8A-8C, similar to FIGS. 7A-7C, show an embodiment of a controller assembly 100 being coupled to a housing 800 of a light fixture. As shown in FIG. 8A a knockout opening 802 may be defined in the housing 800 of the light fixture. As shown in FIG. 8B, the controller assembly 100 may be positioned within the knockout opening 802 so that the end cap 400 and a portion of the mechanical actuator 105 are positioned externally of the housing 800 of the light fixture. As shown, in some embodiments the end cap 400 may be coupled to the main body portion 200 with the user input assembly 104 inside the internal cavity 204 prior to insertion of the controller assembly 100 into the knockout opening 802. As shown in the internal light fixture housing view of FIG. 8C, the nut 107 may be threaded onto the main body portion 200 in order to clamp the light housing fixture 800.

In some embodiments, a light fixture housing 700 800, including a controller assembly 100, may be suspended from a ceiling, for example by hangers which may be cables, chains, rods, or other suitable hangers. The light fixture may direct downlight downward into a room, and the controller assembly may be accessible from the external portion of the light fixture housing allowing the light properties of the downlight to be adjusted after installation without accessing the internals of the light fixture housing. This is beneficial in allowing a change of the output light properties without programming the driver or stocking multiple different specific drivers.

Figure 10:
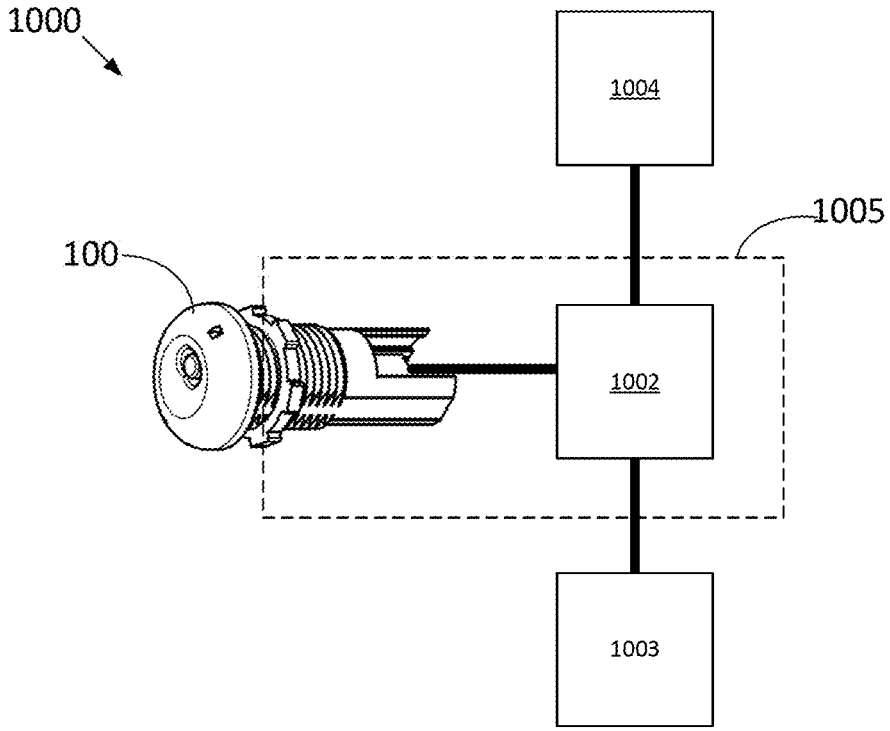
FIG. 10 shows a schematic diagram of a light fixture including a knockout mountable light fixture controller assembly according to embodiments of the present technology.

The circuitry of the user input assembly 104 may be coupled to circuitry of the light fixture. For example, the circuitry of the user input assembly 104 may be coupled to one or more drivers, for driving light sources of the light fixture. FIG. 10 shows a schematic diagram of a light fixture 1000 including a controller assembly 100, as discussed above. As shown, the light fixture 1000 includes a controller assembly 100 electrically coupled to a driver 1002. In some embodiments, the controller assembly 100 may be coupled to a controller coupled to one or more drivers 1002. The driver 1002 is connected to a power source 1004. The power source 1004 may provide power to the controller assembly 100. In some embodiments, the light fixture operates on direct current (DC) power supplied by the power source 1004, e.g. a transformer. The power source may be mounted outside of the housing 1005 of the light fixture, as shown in FIG. 10, or within the housing 1005 of the light fixture.

The light fixture may further include one or more light sources 1003. The light sources may be electrically coupled to the drivers 1002. The light sources 1003 may include LEDS, and the drivers 1002 may be LED drivers. The drivers 1002 may receive DC power from the power source 1004. The drivers 1002 may produce controlled current, based on a control signal received from the controller assembly 100, that is routed to the light sources.

It will be apparent to those skilled in the art that various modifications and variations can be made in the method and system of the present invention without departing from the spirit or scope of the invention. Thus, it is intended that the present invention include modifications and variations that are within the scope of the appended claims and their equivalents. It is to be understood that any workable combination of the features and capabilities disclosed herein is also considered to be disclosed.

What is claimed is:

1. A controller assembly for a ceiling light fixture, comprising:

a controller housing configured to be received within a knockout opening of a light fixture housing of said ceiling light fixture from which light is emitted; and a user input assembly positioned within the controller housing, the user input assembly comprising:

a mechanical actuator configured to be accessible through a controller opening in the controller housing, a connector interface configured to be electrically connected by wiring to a driver of the light fixture, and circuitry electrically coupled to the mechanical actuator and the connector interface, wherein the circuitry is configured to detect actuation of the mechanical actuator by a user and, in response, change a control signal from the connector interface to the driver from a first control signal to a second control signal in order to change a property of the emitted light, wherein the first control signal and the second control signal differ from one another by at least one property selected from a group consisting of resistance, voltage, current, and modulation.

2. The controller assembly of claim 1, wherein the controller housing comprises:

a main body portion, wherein the main body portion defines an internal cavity and the user input assembly is positioned within the internal cavity, and wherein the main body portion defines a first end and a second end opposite the first end, and an end cap coupled to the first end of the main body portion, wherein the end cap defines the controller opening proximate the first end of the main body portion.

3. The controller assembly of claim 2, further comprising:

a nut, wherein the main body portion defines a sidewall and a flange extending radially from the sidewall, wherein the sidewall defines threading proximate to the flange, wherein the nut is threadedly coupled to the threading, and wherein the nut and flange are configured to clamp the light fixture housing around the knockout opening in order to couple the controller housing to the light fixture housing.

4. The controller assembly of claim 3, wherein the main body portion defines a top portion and a bottom portion, wherein the top portion and the bottom portion are configured to snap together to define the main body portion, and wherein the top and bottom portions each define a portion of the flange and a portion of the threading.

5. The controller assembly of claim 3, wherein the end cap is adapted to rotatably couple to the flange.

6. The controller assembly of claim 5, wherein the flange defines a T-shaped channel, wherein the end cap defines a tab, and wherein the end cap is adapted to rotatably couple to the flange by inserting the tab into the T-shaped channel and rotating the end cap relative to the flange.

7. The controller assembly of claim 5, wherein the controller opening in the end cap is offset radially from an axis of rotation of the end cap.

8. The controller assembly of claim 7, wherein the mechanical actuator is configured to extend through the controller opening during rotational coupling of the end cap to the flange.

9. The controller assembly of claim 8, wherein the controller opening is arc shaped.

10. The controller assembly of claim 8, wherein the mechanical actuator comprises a toggle push button.

11. The controller assembly of claim 8, wherein the mechanical actuator comprises a rotatable dial.

12. The controller assembly of claim 2, wherein an interior sidewall of the main body portion defines channels, wherein the circuitry comprises a printed circuit board, and wherein the printed circuit board is configured to engage the channels and be inserted into the internal cavity by sliding along the channels.

13. The controller assembly of claim 12, wherein end stops block the channels proximate the second end of the main body portion, and wherein the printed circuit board is retained within the internal cavity by the end cap and the end stops.

14. The controller assembly of claim 2, wherein the main body portion defines a main body opening proximate the second end of the main body portion, and wherein the main body opening is configured to provide access to the connector interface in order for the wiring to extend from the connector interface out of the internal cavity and be routed to the driver of the light fixture.

15. A ceiling light fixture configured to attach to, or be suspended from, a ceiling, comprising:

the controller assembly of claim 1;

a light fixture housing defining a knockout opening, wherein the controller assembly is positioned within the knockout opening;

a light source; and a driver positioned within the light fixture housing and electrically coupled to the controller assembly and the light source, wherein the driver is configured to drive the light source, wherein the driver is configured to receive a control signal from the user input assembly of the controller assembly and, in response to detecting a change from receiving a first control signal to receiving a second control signal, change a drive signal to the light source from a first drive signal corresponding to a first light property setting to a second drive signal corresponding to a second light property setting, wherein the first control signal and the second control signal differ from one another by at least one property selected from a group consisting of resistance, voltage, current, and modulation.

16. The light fixture of claim 15, wherein the first and second light property settings are light intensity settings.

17. The light fixture of claim 15, wherein the first and second light property settings are color temperature settings.

18. A method of assembling a ceiling light fixture configured to attach to, or be suspended from, a ceiling, the method comprising:

providing the ceiling light fixture comprising:

a light fixture housing comprising a knockout defining a knockout opening;

a light source configured to emit light and a driver positioned within the light fixture housing and configured to drive the light source with a drive signal;

providing a controller assembly comprising:

a controller housing; and a user input assembly positioned within the controller housing and comprising:

a mechanical actuator configured to be accessible through a controller opening in the controller housing, a connector interface, and circuitry electrically coupled to the mechanical actuator and the connector interface, removing the knockout from the light fixture housing to expose the knockout opening;

inserting the controller housing into the knockout opening; and connecting wiring between the connector interface and the driver to electrically couple the controller assembly to the driver, wherein the circuitry of the user input assembly is configured to detect actuation of the mechanical actuator by a user and, in response, change a control signal from the connector interface to the driver from a first control signal to a second control signal in order to change a property of the emitted light, and wherein the driver is configured to receive the second control signal and change the drive signal to the light source from a first drive signal corresponding to a first light property setting to a second drive signal corresponding to a second light property setting, wherein the first control signal and the second control signal differ from one another by at least one property selected from a group consisting of resistance, voltage, current, and modulation.

19. The method of claim 18, wherein the controller housing comprises a main body portion, wherein the main body portion defines a sidewall and a flange extending radially from the sidewall, wherein the sidewall defines threading proximate to the flange, wherein the method further comprises threading a nut onto the threading in order to clamp a portion of the light fixture housing around the knockout opening between the nut and the flange.

20. The method of claim 19, wherein the controller housing further comprises an end cap, wherein the end cap defines the controller opening, wherein the method further comprises coupling the end cap to the main body portion by rotating the end cap relative to the main body portion with a portion of the mechanical actuator extending through the controller opening.

21. The controller assembly of claim 1, wherein the controller housing comprises:

a cylindrical main body portion comprising a sidewall having a length that extends along a longitudinal axis, wherein a sidewall opening is defined in the sidewall along a least a portion of the length of the sidewall.

22. The controller assembly of claim 1, wherein the controller housing comprises:

a main body portion comprising an internal cavity and channels projecting radially inward and extending parallel to a longitudinal axis within the internal cavity, wherein the channels are configured to secure the user input assembly to the main body portion.

23. The controller assembly of claim 1, wherein the mechanical actuator does not extend beyond an outer surface of the controller housing.

* * * * *